US005820530A

United States Patent [19]

Kallassy

[11] Patent Number: 5,820,530

[45] Date of Patent: Oct. 13, 1998

[54] AQUATIC EXERCISE DEVICE

[76] Inventor: Charles Kallassy, 4074 S. Better Dr., Dallas, Tex. 75229

[21] Appl. No.: 823,514

[22] Filed: Mar. 24, 1997

Related U.S. Application Data

[62] Division of Ser. No. 541,036, Oct. 11, 1995, Pat. No. 5,643,155, which is a continuation of Ser. No. 146,873, Nov. 2, 1993, abandoned.

[51] Int. Cl.[6] ..... A63B 31/00

[52] U.S. Cl. ..... 482/111; 482/55; 441/119

[58] Field of Search ..... 482/51, 55, 74, 482/105, 111; 441/106, 108, 113, 114, 119; 602/13

[56] References Cited

U.S. PATENT DOCUMENTS

| | | | |
|---|---|---|---|
| 16,555 | 2/1857 | Simonds | 441/114 |
| 1,492,041 | 4/1924 | Long | 441/108 |
| 3,920,006 | 11/1975 | Lapidus | 602/13 |
| 4,266,298 | 5/1981 | Graziano | 602/13 |
| 4,671,507 | 6/1987 | Huttner | 482/105 |
| 4,862,879 | 9/1989 | Coombe | 602/13 |
| 5,022,879 | 6/1991 | DiForte | 441/108 |

*Primary Examiner*—Lynne A. Reichard
*Attorney, Agent, or Firm*—Darby & Darby

[57] ABSTRACT

An aquatic exercise device includes two substantially identical flexible sheets of gas impermeable material. The sheets are sealed together to form at least two separate variably inflatable chambers having a safety valve disposed in each chamber to inflate, deflate or close the chamber. Four different embodiments of the aquatic exercise device, a cuff, a belt, a head gear and a flex device, may be used together or separately. The inflatable chambers of the aquatic exercise devices are adjusted individually to place substantially all patients in the optimal biomechanical positions while simultaneously preventing the undesirable migration of the device with respect to the body.

9 Claims, 7 Drawing Sheets

AQUATIC EXERCISE DEVICE

This is a division, of application Ser. No. 08/541,036, filed Oct. 11, 1995, now U.S. Pat. No. 5,643,155, the disclosure of which is hereby incorporated by reference, which is a continuation of Ser. No. 08/146,873, filed Nov. 2, 1993 now abandoned, the disclosure of which is hereby incorporated by reference.

FIELD OF THE INVENTION

The present invention relates generally to aquatic exercise devices. More specifically, the present invention relates to aquatic exercise devices that have a plurality of variably inflatable chambers which may be used for both deep water exercise and therapeutic purposes.

BACKGROUND OF THE INVENTION

A recently popular form of exercise and therapy, aquatic exercising devices present unique operating conditions to the body because of their use of water resistance and their buoyancy. By making proper use of water resistance, such devices can provide the body with excellent muscular and cardiovascular training. At the same time, the buoyancy offered by these devices eliminates the stress and injuries associated with the jarring impact of such land-based exercises as running and aerobics. Aquatic exercise devices are frequently of the type having a fixed buoyancy such as those disclosed in U.S. Pat. Nos. 4,689,030 to McWaters and 5,000,710 to Bedortha et al. Other aquatic exercise devices such as those disclosed in U.S. Pat. Nos. 2,312,976 to Pels and 4,496,328 to Asher et al, have inflatable chambers which have a tendency to ride up on the body of the user.

Although the foregoing aquatic exercise devices have been available, there are still major problems involved in their use. The fixed buoyancy devices can not be adjusted sufficiently in buoyancy to place a patient receiving physical therapy in the optimal biomechanical position for basic aquatic exercises. The inflatable aquatic exercise devices ride upward on the body and tend to irritate the skin. Additionally, the use of shoulder and torso straps tend to make the use of these devices uncomfortable to the user.

It is therefore an object of the invention to provide an aquatic exercise system which places substantially all patients in the optimal biomechanical position while simultaneously preventing the undesirable migration of the device with respect to the body during use.

Yet another object of the invention is to allow the user to perform running or other exercises in water in a manner that allows the exact duplication of that exercise as performed on land.

It is also an object of the present invention to provide an aquatic exercise device that requires fewer parts and, thus, is smaller, especially when deflated, and is easier to manufacture. It is still a further object of the present invention that the aquatic exercise device be simple and cost effective to manufacture, yet reliable and efficient in use.

Yet another object of the present invention to provide an aquatic exercise device comprising at least two substantially identical flexible sheets of gas impermeable material being sealed together to form a plurality of separate variably inflatable chambers. Each of the chambers has an outlet means for selectively inflating, deflating and sealing the chamber. An uninflatable strip is formed between at least two of the chambers to define a hinge therebetween. The two chambers and the hinge conforming closely to the contours of the human body. The two sheets are attached to the human body.

BRIEF DESCRIPTION OF THE DRAWINGS

The above and still further objects, features and advantages of the present invention will become apparent upon consideration of the following detailed description of presently preferred embodiments thereof, especially when taken in conjunction with the accompanying drawings wherein like reference numerals in the various figures are utilized to designate like components, and wherein.

DETAILED DESCRIPTION OF THE PRESENTLY PREFERRED EXEMPLARY EMBODIMENTS

Figure 1:
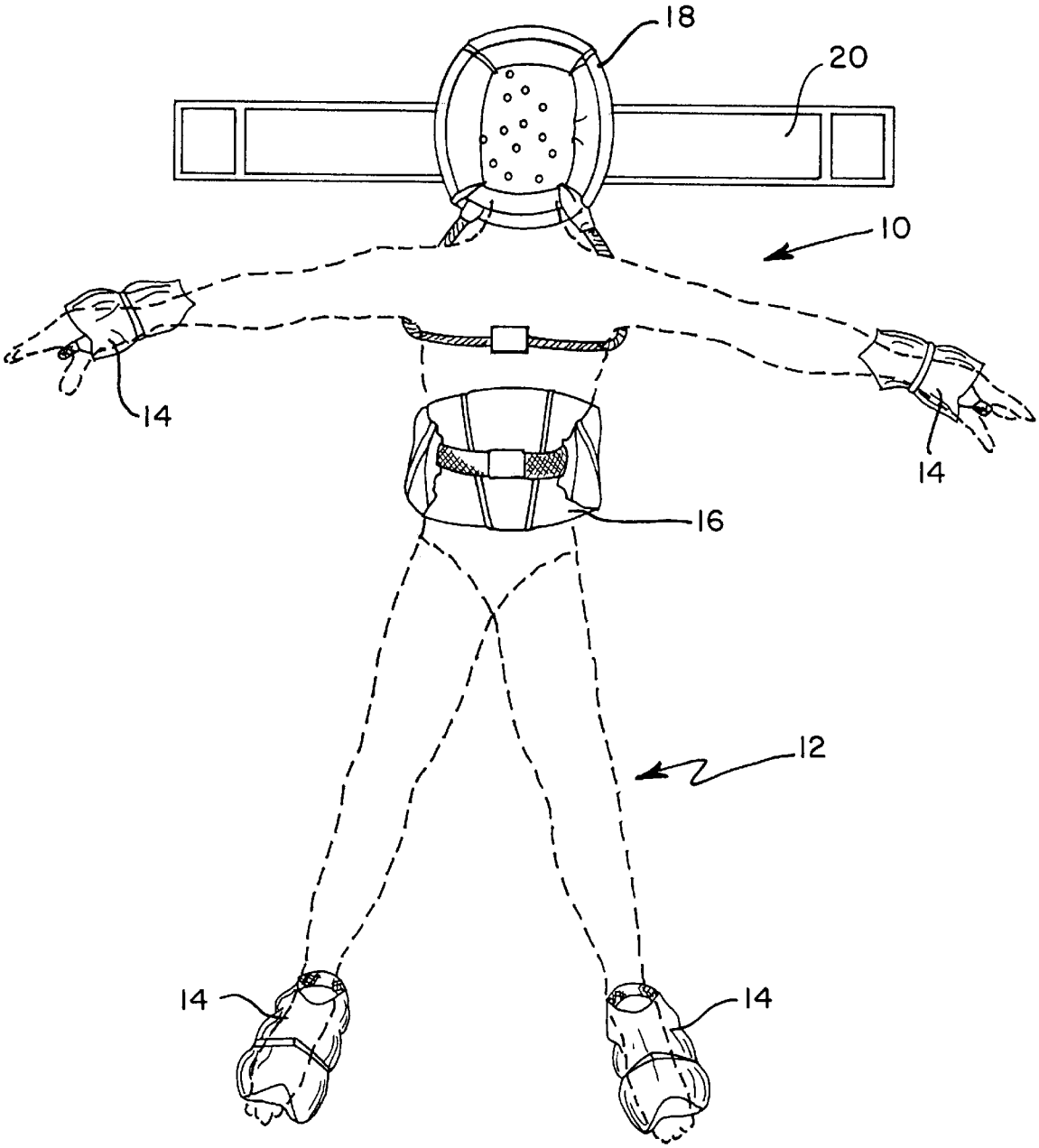
FIG. 1 is a perspective view of a user in water wearing an inflatable cuff device, an inflatable belt device, an inflatable head gear device and an inflatable flex device according to the present invention.
Figure 2:
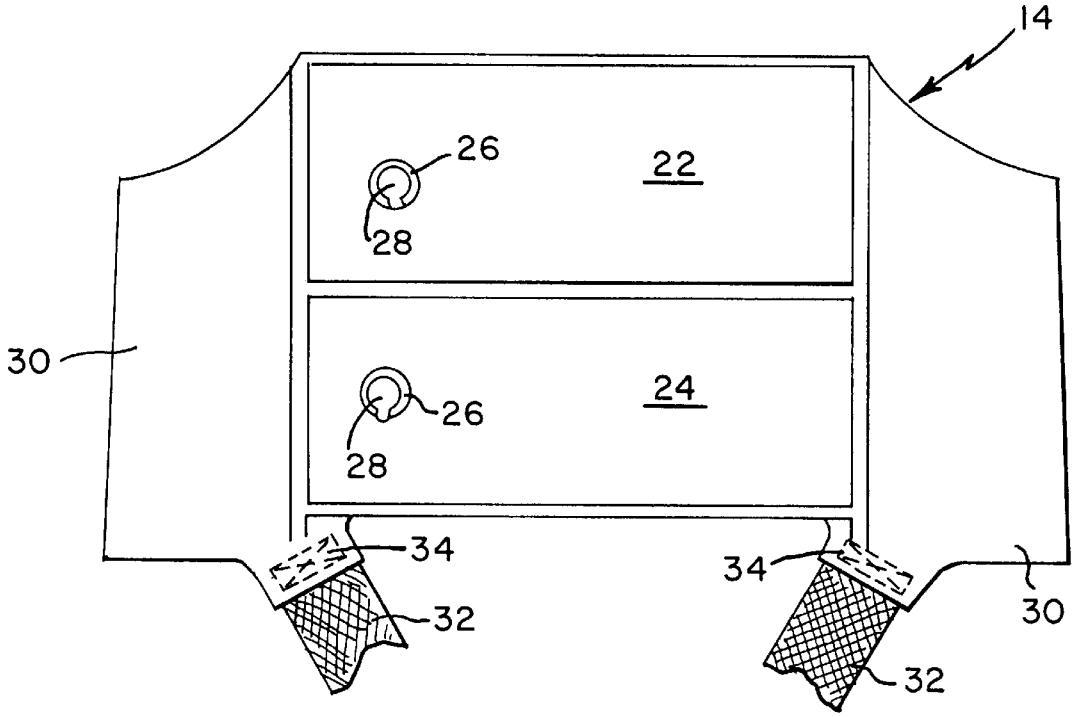
FIG. 2 is a plan view of a cuff device according to the present invention.
Figure 3:
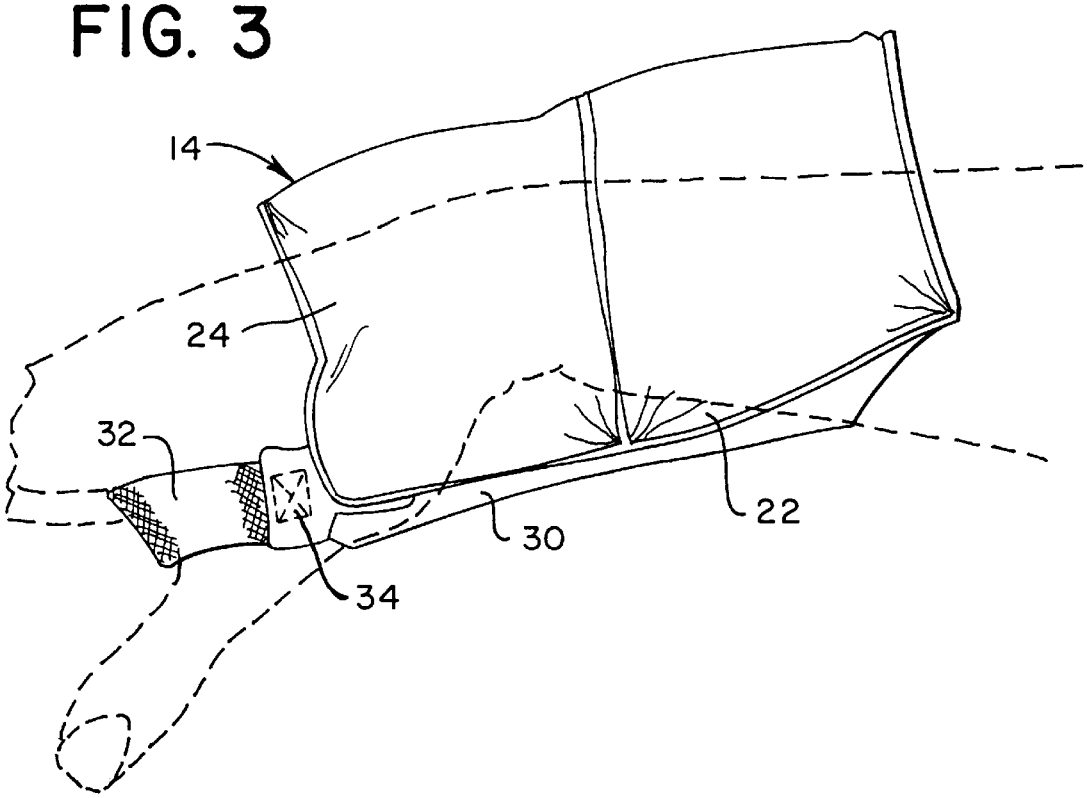
FIG. 3 is a side view of the cuff device according to the present invention worn on the user's hand.
Figure 4:
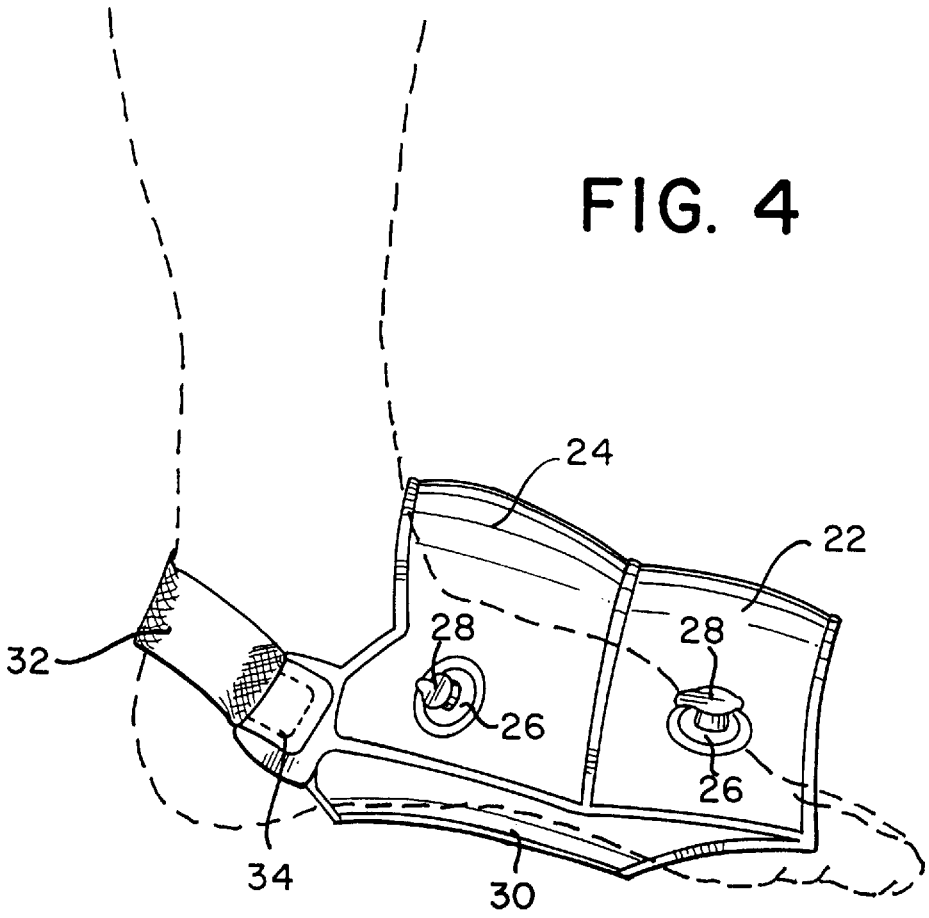
FIG. 4 is a side view of the cuff device according to the present invention worn on the user's foot.

Referring to FIG. 1, a system 10 for aquatic exercising according to the present invention is illustrated, with a patient or exerciser 12 having his/her feet and hands engaged in an adjustable buoyancy cuff 14, an adjustable buoyancy belt 16 being worn about the waist, the patient's head being supported and positioned in an adjustable buoyancy head gear 18, and the head being further supported and balanced by the adjustable buoyancy flex device 20. The exerciser or patient 12 can adjust the position or distribution of the overall amount of buoyancy to compensate for a wide range of body types, physical limitations, handicapping disabilities and workout variations.

Figure 5:
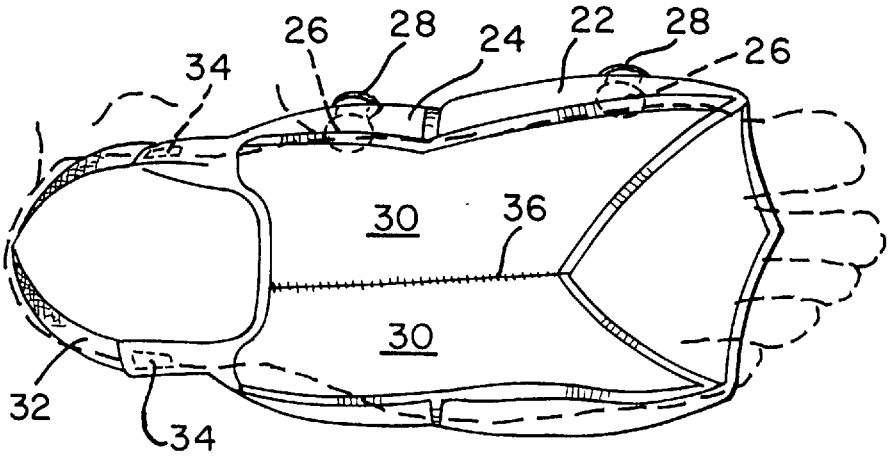
FIG. 5 is a bottom view of the cuff device according to the present invention worn on the user's foot.

Referring now to FIGS. 2–5, each of the adjustable buoyancy cuffs 14 includes a pair of inflatable chambers 22,24 formed between two substantially identical flexible sheets of gas impermeable material, such as supported or unsupported poly vinyl chloride (PVC). Preferably, the unsupported surface of the PVC is disposed on the non-exposed surface of the chambers, while the supported surface is disposed on the exposed surface. One of the processes for forming the supported surface is known as "diamonding". Each chamber includes a conventional outlet safety valve 26 permitting access to the respective chamber to inflate, deflate and seal the chamber. The safety valve includes a built in one-way or check valve and a plug 28 to close the chamber. An uninflatable section 30 of the flexible sheets forms a hollow cylindrical shape with the inflatable chambers 22,24. Arcuate edges 23,25 of the uninflated section 30 are designed to permit the ball of the foot to be exposed to the surface below (see FIGS. 4 and 5). As illustrated in FIG. 5, the uninflatable section 30 includes a longitudinal seam 36 that is preferably radio frequency (R.F.) sealed to provide a smooth seam. In addition to an R.F. seal, the seam 36 may also be sewn in another embodiment (not shown). Also, a strip 25 of uninflated sheets is formed between the chambers 22,24 to act as a hinge. As will be appreciated from FIGS. 3 and 4, the hinge causes the inflated chambers to conform more closely to the contours of the user's limb. In an alternative embodiment (not shown), chambers 22,24 may be combined as one inflatable chamber. A portion of the cylinder formed by the flexible sheets includes an inflatable section and the remaining portion includes an uninflatable section 30. A strap 32 is attached asymmetrical to the flexible sheets at one axial end of the cylinder at the juncture 34 of the inflatable chambers 22,24 and the uninflated section 30. In other words, the junctures 34 are not located diametrically opposite one another. The strap is preferably made of an elastic material. One such material may be a flexible neoprene with nylon laminated to each side.

Figure 6:
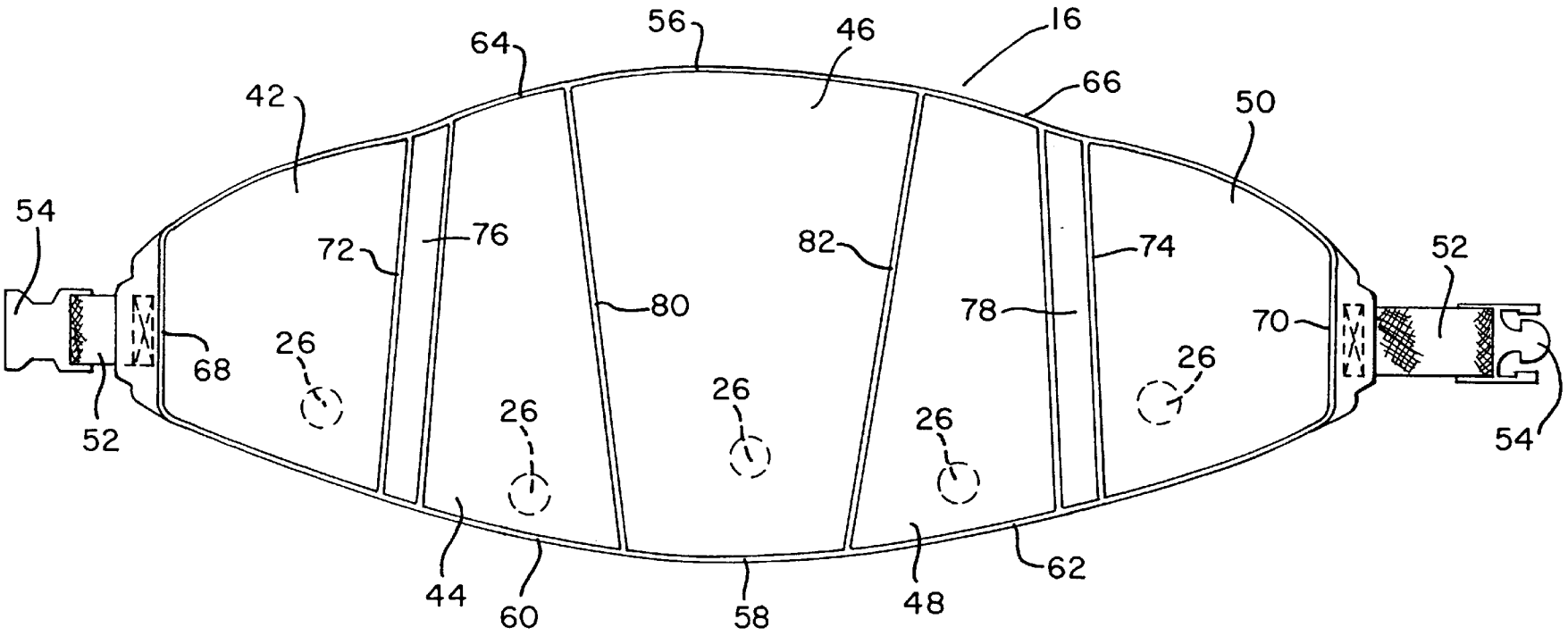
FIG. 6 is a plan view of a belt device according to the present invention.
Figure 7:
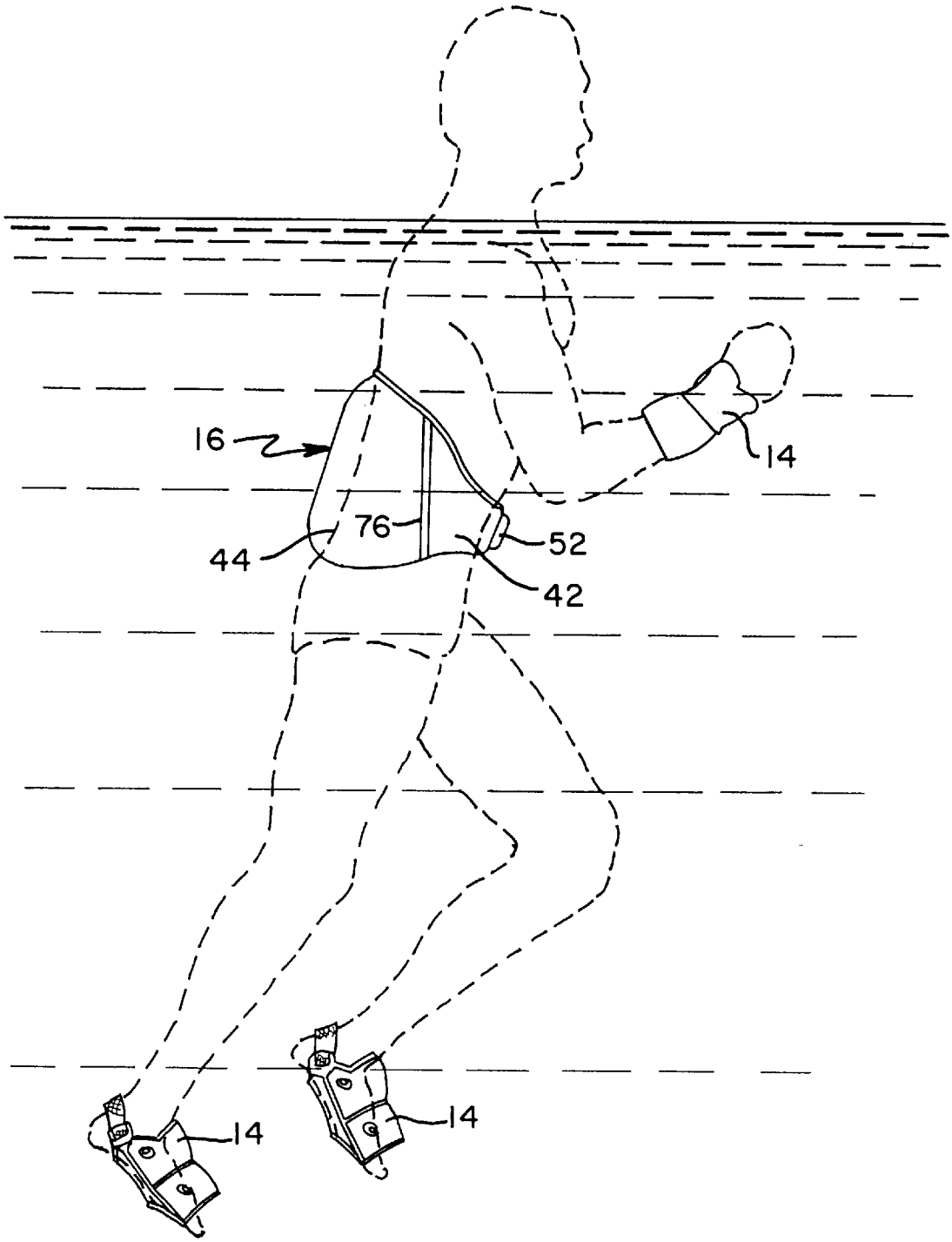
FIG. 7 is a side view of the belt device according to the present invention worn about the user's waist.

Referring now to FIGS. 6 and 7, the adjustable buoyancy belt 16 includes five inflatable chambers 42,44,46,48,50 formed between two substantially identical flexible sheets of gas impermeable material, such as supported or unsupported PVC. Each chamber includes a conventional outlet safety valve 26 permitting access to the respective chamber to inflate, deflate and seal the chamber. The safety valve includes a built in one-way or check valve and a plug 28 to close the chamber. A strap 52 is attached to each end of the belt. A buckle 54 is attached to the end of the strap opposite to the end attached to the belt. The strap 52 is preferably made of a flexible webbing material which does not absorb water. One such material may be, for example, polypropolene. The buckle itself may be of any conventional type that allows for a quick connection and disconnection and length adjustment of the strap. Alternatively, the strap 52 may extend from only one of the chambers and can pass through an eyelet located at the other chamber and can be tightened by threading the strap 52 through a conventional buckle or the like. As is conventional, a single strap may be provided at one end of the belt which includes surfaces with mating hook and pile fabric known as "velcro". The other end of the belt would include an eyelet through which the belt could be looped and then adjustably tightened by means of the mating surfaces.

The five inflatable chambers include a middle chamber 46, a pair of end chambers 42,50 and a pair of intermediate chambers 44,48. The middle chamber 46 is in the shape of a trapezoid having a greater length upper base 56 and a lesser length lower base 58. Each of the intermediate chambers 44,48 is adjacent to the middle chamber 46 and has a substantially trapezoidal shape. The intermediate chambers 44,48 have a greater length lower base 60,62 which is adjacent to the middle chamber's lesser length lower base 58, and they have a lesser length upper base 64,66 adjacent to the middle chamber's greater length upper base 56. Each of the end chambers 42,50 is adjacent to one of the intermediate chambers 44,48 such that one intermediate chamber 44,48 is disposed between the middle chamber 46 and one end chamber 42,50. Each of the end chambers 42,50 can also be said to be substantially in the shape of a trapezoid, having a lesser length outer edge 68,70 remote from the respective intermediate chamber 44,48. The end chamber has a greater length inner edge 72,74 on a side adjacent to the adjacent the respective intermediate chamber 44,48. In an alternative embodiment (not shown) chambers 44,46 and 48 would be combined to form one chamber which is separate from chambers 42,50. Of course, this embodiment would provide less adjustability because it has fewer chambers.

Each one of the intermediate chambers 44,48 is disposed between the middle chamber 46 and a respective one of the end chambers 42,50. An uninflated strip 76, 78 of the flexible sheets is disposed between each of the adjacent end and intermediate chambers to act as a hinge therebetween. Similarly, an uninflated strip 80, 82 of the flexible sheets is disposed between each of the adjacent intermediate and middle chambers to form a slanted hinge therebetween. When the belt 16 is in use, attached about the waist of the user's body, the inflated chambers 42,44,46,48,50, under the hydrodynamic and hydrostatic pressures of water, conform closely to the body through the action of the hinges, and they cooperate to resist the migrating of the belt 16 up the torso of the body. It is to be understood that relative orientation adjectives such as "up", "down", etc. are utilized herein in the context of the drawings to simplify the present description and are not intended to limit the orientation of the buoyancy devices when in use, especially when used in combination with each other.

Figure 8:
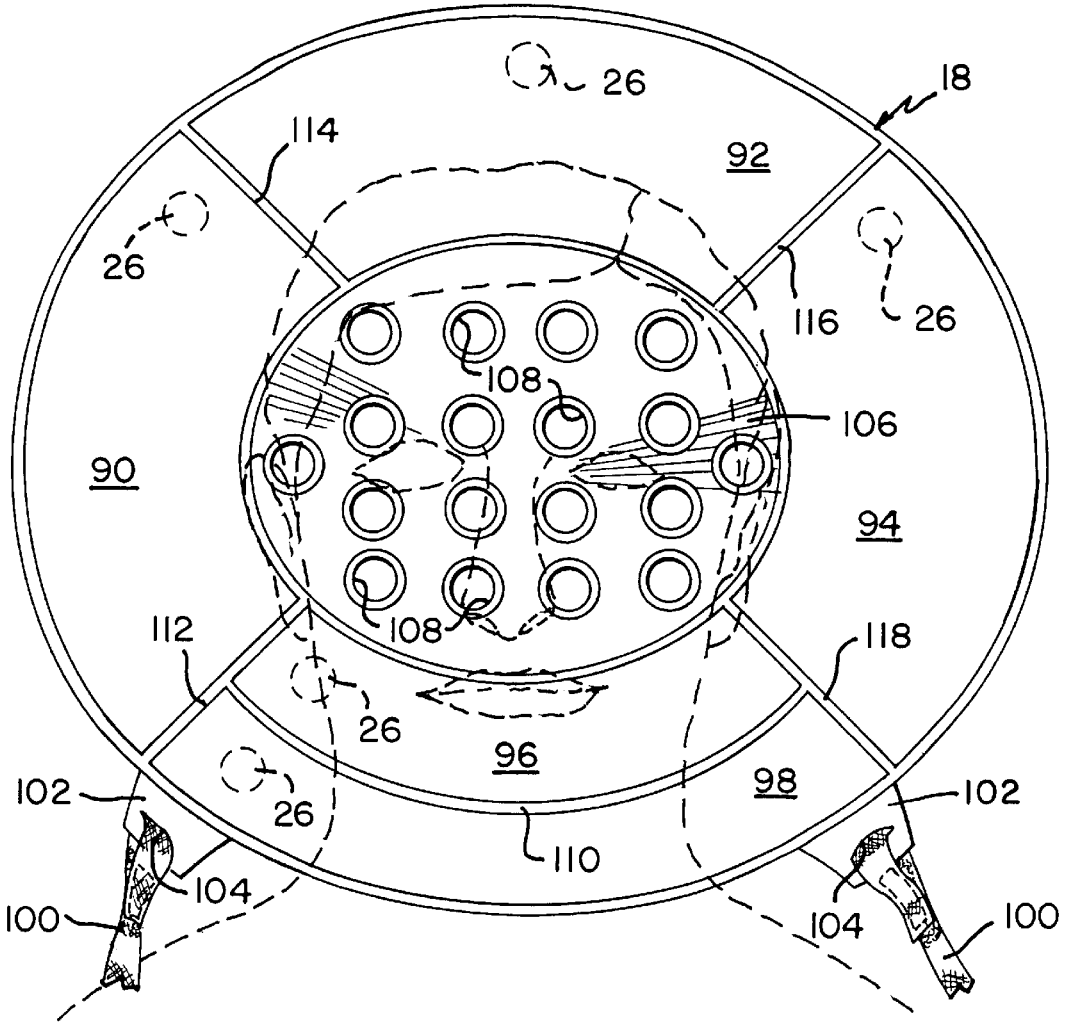
FIG. 8 is a top view of the head gear device according to the present invention supporting the user's head.
Figure 9:
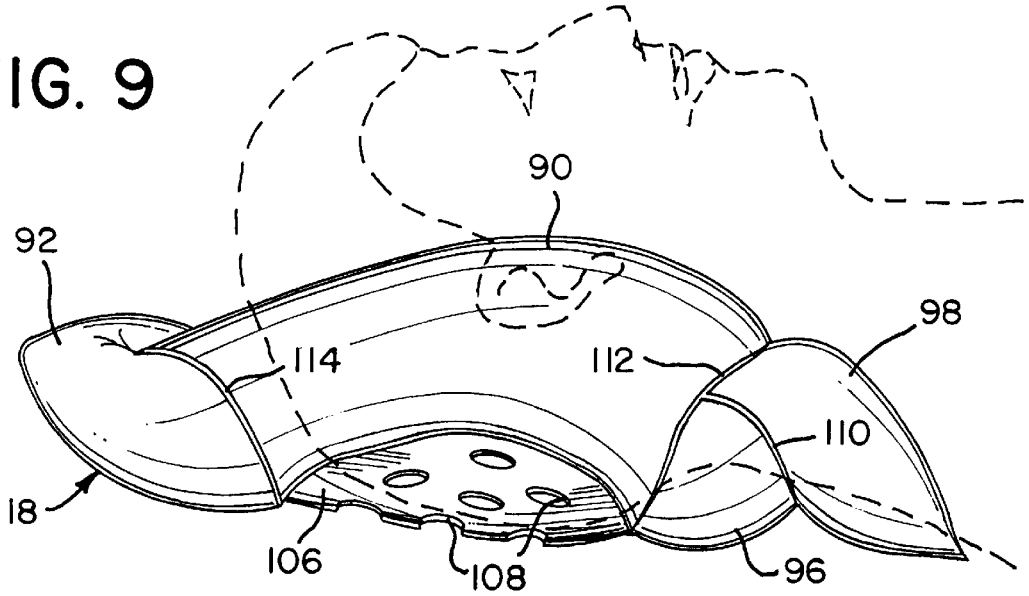
FIG. 9 is a side view of the head gear device according to the present invention supporting the user's head.

Referring now to FIGS. 8 and 9, the adjustable buoyancy head gear 18 includes five inflatable chambers 90,92,94,96, 98 formed between two substantially identical flexible sheets of gas impermeable material, such as supported or unsupported PVC. Each chamber includes a conventional outlet safety valve 26 permitting access to the respective chamber to inflate, deflate and seal the chamber. The safety valve includes a built in one-way or check valve and a plug 28 to close the chamber. The strap 100 is attached to the outer perimeter of the head gear 18 at tab 102,102 disposed adjacent to the ends of the inflatable chamber 98. The strap 100 is preferably made of a flexible webbing material which does not absorb water. One such material may be polypropolene. This strap may also be manufactured from a flexible elastic material. The strap 100 is preferably attached to the head gear 18 by being passed through an eyelet 104 in the tab 102 and reattaching to itself with a hook and pile type fastener. Alternately, strap 100 may be formed in two sections which are connected by a conventional buckle (not shown) at the front of the wearer's chest (see FIG. 1) that allows for quick connection and disconnection of the strap.

The inflatable chambers 90,92,94,96,98 form an annular ring shape. An uninflatable central disc shaped section 106 of the flexible sheets is disposed within the annular ring formed by the chambers 90,92,94,96,98. A plurality of through holes 108 are formed in section 106. Each of the inflatable chambers 90,92,94,96,98 form an arcuate section of the annular ring. Additionally, chambers 96,98 are disposed in the same arcuate section and are separated by an uninflated strip 110 of the flexible sheets to form a hinge therebetween. An uninflated strip 112,114,116,118of the flexible sheets is also disposed between each of the adjacent inflatable arcuate chambers 90,92,94 and between chambers 90 and 96,98 and chambers 94 and 96,98 to form a hinge therebetween. When the head gear 18 is in use to support and position the head of the user, the inflated chambers 90,92, 94,96,98 and the hinges therebetween cooperate to buoyantly support and cradle the head above the water line while preventing water from splashing or collecting about the face (see FIG. 9). Also, water will not form puddles at the sides of the user's head, but will seep under the head and through holes 108. In an alternate embodiment, chambers 96 and 98 may be combined as one inflatable chamber similar to chamber 92.

Figure 10:
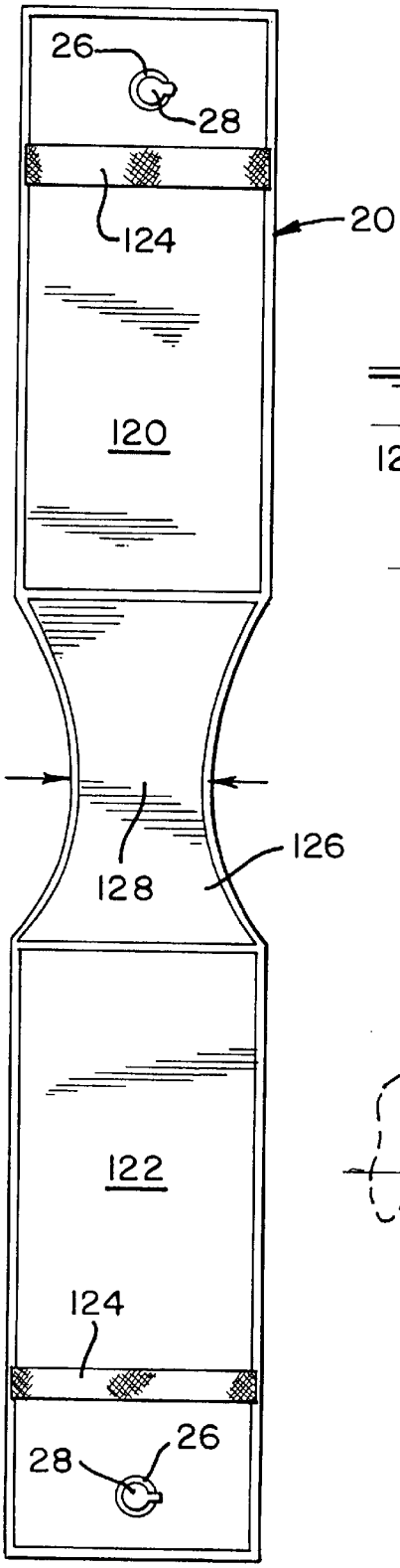
FIG. 10 is a top view of the flex device according to the present invention.
Figure 11:
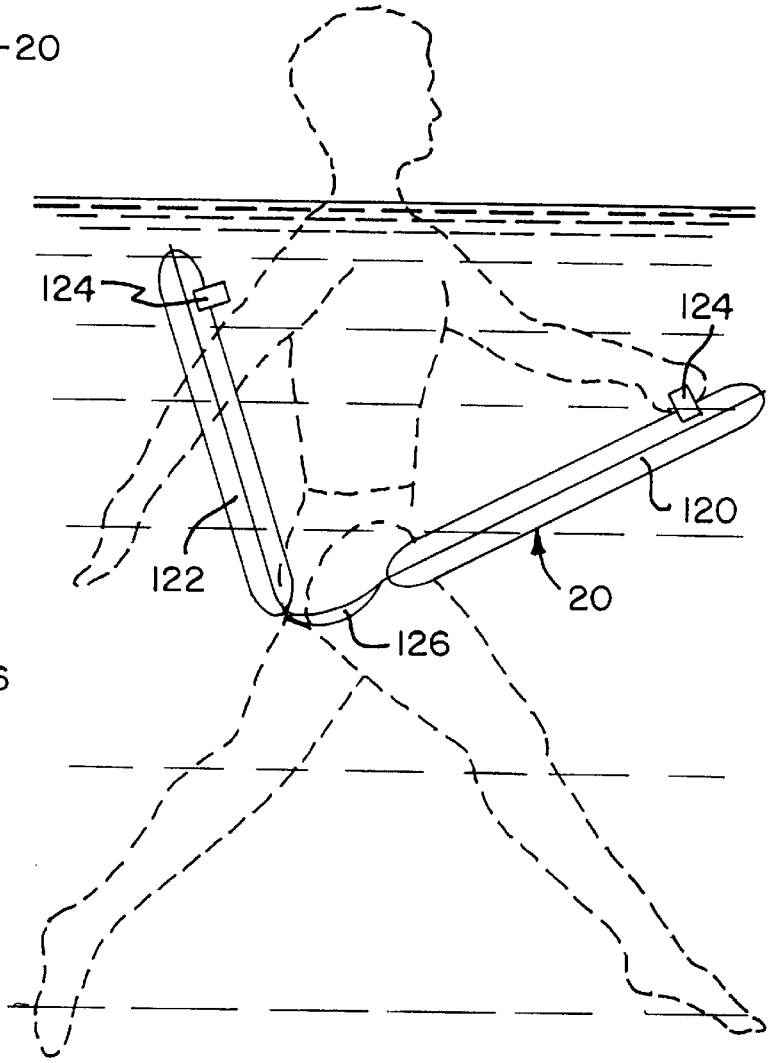
FIG. 11 is a side view of the flex device according to the present invention supporting the user's body.

Referring now to FIGS. 10 and 11, the adjustable buoyancy rectangular shaped flex device 20 includes two inflatable chambers 120,122 formed between two substantially identical flexible sheets of gas impermeable material, such as supported or unsupported PVC. Each chamber includes a conventional outlet safety valve 26, allowing access to the respective chamber to inflate, deflate and seal the chamber. The safety valve includes a built in one-way or check valve and a plug 28 to close the chamber. A strap 124 is attached adjacent to each end of the flex device 20 by sewing, for example. The strap 124 is preferably made of a flexible webbing material which does not absorb water. One such material may be polypropolene. An uninflatable bridge section 126 is disposed between the two inflatable chambers 120,122. The bridge section 126 has a width 128 which is less than the width of the two inflatable chambers 120,122.

The use of the aquatic exercise devices of the present invention will be described below with reference to FIGS. 1–11. More specifically, the use of the adjustable buoyancy cuffs 14 will be described with reference to FIGS. 1–5. The cuffs 14 are preferably worn in pairs on either the hands or the feet or on both the hands and feet. The buoyancy and water resistance created by using the cuffs 14 is designed to duplicate the muscular and proprioceptive responses of running or walking on land. The buoyancy and resistance created by the cuffs 14 also create a greater workload for the exerciser, thus allowing for a more rigorous muscular and cardiovascular workout. Because the chambers 22,24 can be inflated to varying degrees, all users can be assured of maintaining a secure fit between the hands and/or feet of the user and the inner cylindrical surface of the cuffs 14. The uninflated section 30 of the cylindrical shape is preferably disposed adjacent to the bottom portion of the foot to resist slipping and for comfort, or adjacent the palm of the hand and wrist so as to not disturb the normal swing of the arm during running in water. The chambers 22,24 can be inflated to a greater degree to increase the buoyancy and the resistive effect.

The use of the adjustable buoyancy belt 16 will be described with reference to FIGS. 1, 6 and 7. The five inflatable chambers 42,44,46,48,50 provide a convenient means by which an exerciser or patient can adjust his/her position to the preferred position which emulates the optimal biomechanical position for basic aquatic exercises and running as illustrated in FIG. 7. The inflatable chambers are designed to compensate for a wide variety of body types, physical limitations, handicapping disabilities and workout variations because a fixed distribution of buoyancy is rarely desirable. By simply adjusting the amount of inflation in all or individual chambers 42,44,46,48,50 the amount of overall buoyancy and also the degree of body tilt anteriorly/posteriorly, medially/laterally, etc., can be varied. Additionally, because the chambers are variably inflatable, an elastic strap is not required to attach the adjustable buoyancy device to the body. The inflation of the contoured chambers in cooperation with the hinges therebetween and the hydrodynamic and hydrostatic pressures of water will create enough friction between the flexible sheets and the body to resist movement of the buoyancy device with respect to the body. Additionally, the angled orientation of the chambers in concert with the uninflatable strips therebetween provide a more comfortable and tapered fit of the belt 16 to the body. Additionally, the buoyancy of the belt 16 helps stretch the spinal area to increase the mobility, or range of motion, of the user's lumbar spine.

The use of the head gear 18 will be described with reference to FIGS. 1, 8 and 9. The head gear 18 is designed to be placed under the head of the user to support and position the face above the water line. The actual alignment of the head can be controlled by adjusting the degree of inflation of the individual chambers 90,92,94,96,98. For rotational exercises and/or to increase strength and flexibility of the neck one or more of the chambers may be inflated more than the other chambers. Additionally, it is preferred to inflate chamber 98 to a lesser degree than chamber 96, with chamber 96 being inflated to a lesser degree than chambers 90,92,94. In this manner, the neck can be adequately supported. This is of particular importance when disabled users, such as paraplegics are being exercised. Of course, the chambers 90,92,94,96,98 can be inflated to accommodate the comfort and positioning needs of each individual user.

Central disc shaped section 106 receives the rear of the head. To prevent water from splashing or accumulating about the face, section 106 has a plurality of through holes 108 to allow water to drain out from the trough created on the upper surface of section 106 when the head is placed thereon. In this manner, even the most timid and fearful user will feel confident that use of head gear 18 will substantially prevent all water from splashing or accumulating about his/her face during normal use.

The use of the rectangular shaped flex device 20 will be described with reference to FIGS. 1, 10 and 11. The flex device is designed to be used as a multi-purpose aquatic exercise and positioning device. As illustrated in FIG. 1, the flex device 20 can be used as a positioning and balancing device about the neck in concert with belt 16, cuffs 14 and headgear 18. The flex device 20 can also be placed under the torso, legs, arms or wherever additional buoyancy or resistance is desired. Alternatively, flex device 20 can be used as a resistance device for increasing muscular flexibility, strength and balance, for example, by placing the uninflated bridge section 126 about the waist or shoulders during running exercise. As illustrated in FIG. 11, the flex device can be used alone, for example, by straddling it about the bridge section.

As a system, the buoyancy of devices 14,16,18 and 20 can be adjusted quickly and easily to compensate for different body types, different physical limitations, different personal requirements and for the interactive use of additional buoyancy devices. For example, when using belt 16, with cuffs 14 on the hands, additional buoyancy is provided to the front of the body. Thus, the body has a tendency to tilt posteriorly and out of the upright and slightly forward position (see FIG. 7) that is biomechanically correct for basic water running. By adjusting the buoyancy of the belt, by either reducing the inflation of the front chambers 42,50 or increasing the inflation of the back middle chamber 46, or both, the user can maintain the optimal biomechanical position. Additionally, the use of cuffs 14 on the hands and/or feet can also be used to adjust the position of the body and to more specifically duplicate the muscular and proprioceptive responses of running or walking on land (see FIG. 7).

It will be appreciated that the variably inflatable buoyancy devices of the present invention successfully position and support the body in water for exercising or therapy. From the foregoing description, it will be appreciated that the present invention makes available compact, especially when deflated, cost efficient buoyancy devices. The buoyancy devices are designed to be simply operated while maintaining the body in an optimal biomechanical position.

Having described presently preferred exemplary embodiments of a new and improved buoyancy device in accordance with the present invention, it is believed that other modifications, variations and changes will be suggested to those skilled in the art in view of the teachings set forth herein. It is, therefore, to be understood that all such variations, modifications, and changes are believed to fall within the scope of the present invention as defined by the appended claims.

What is claimed is:

1. An aquatic exercise device for the human body, comprising:

at least two substantially identical flexible sheets of gas impermeable material being sealed together to form a plurality of separate variably inflatable chambers, each of said chambers having an outlet means for selectively inflating, deflating and sealing said chamber, said flexible sheets have an outer oval perimeter, said plurality of chambers forming an annular ring shape, and an uninflatable section of said flexible sheets having a disc shape being disposed within said plurality of chambers, said uninflatable section including a plurality of through holes;

an uninflatable strip formed between at least two of said chambers to define a hinge therebetween, said at least two of said chambers, when inflated cooperating with said hinge to conform said device closely to the contours of at least a portion of the body; and means for attaching said at least two sheets to the body.

2. The aquatic exercise device according to claim 1, wherein each of said plurality of chambers is in the shape of an arcuate segment.

3. The aquatic exercise device according to claim 2, wherein one of said plurality of chambers is divided into two separate arcuate shaped chambers, with one of said two separate arcuate shaped chambers being disposed radially within the other.

4. An aquatic exercise device for the human body, comprising:

at least two substantially identical flexible sheets of gas impermeable material being sealed together to form a plurality of separate variably inflatable chambers, each of said chambers having an outlet means for selectively inflating, deflating and sealing said chamber, said flexible sheets have an uninflatable section, said plurality of inflatable chambers form a hollow cylindrical shape with said uninflatable section, said cylindrical shape having a first axial end and a second axial end, a strap being attached to one of said axial ends;

an uninflatable strip formed between at least two of said chambers to define a hinge therebetween, said at least two of said chambers, when inflated cooperating with said hinge to conform said device closely to the contours of at least a portion of the body; and means for attaching said at least two sheets to the body.

5. The aquatic exercise device according to claim 4, wherein said strap is made of an elastic material.

6. The aquatic exercise device according to claim 5, wherein said strap is attached asymmetrically to said one axial end.

7. An aquatic exercise device for the human body, comprising:

at least two substantially identical flexible sheets of gas impermeable material being sealed together to form a plurality of separate variably inflatable chambers, each of said chambers having an outlet means for selectively inflating, deflating and sealing said chamber, said flexible sheets have an elongated rectangular shape, an uninflatable bridge section of said flexible sheets being disposed between two of said plurality of chambers;

an uninflatable strip formed between at least two of said chambers to define a hinge therebetween, said at least two of said chambers, when inflated cooperating with said hinge to conform said device closely to the contours of at least a portion of the body; and means for attaching said at least two sheets to the body.

8. The aquatic exercise device according to claim 7, wherein said bridge section has an average width which is less than an average width of said two inflatable chambers.

9. The aquatic exercise device according to claim 8, further including a handle strap being attached to each end of said flexible sheets.

* * * * *